US007216608B2

(12) United States Patent
Fujie

(10) Patent No.: US 7,216,608 B2
(45) Date of Patent: May 15, 2007

(54) ENGINE COOLING APPARATUS

(75) Inventor: Katsuyuki Fujie, Kawagoe (JP)

(73) Assignee: Denyo Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 11/166,241

(22) Filed: Jun. 27, 2005

(65) Prior Publication Data

US 2005/0284423 A1 Dec. 29, 2005

(30) Foreign Application Priority Data

Jun. 29, 2004 (JP) ..... 2004-191752

(51) Int. Cl.
*F01P 7/02* (2006.01)
*F01P 7/10* (2006.01)
*F01N 5/02* (2006.01)

(52) U.S. Cl. ..... 123/41.12; 123/41.49; 165/41; 165/51

(58) Field of Classification Search ..... 123/41.12, 123/41.49, 41.65, 41.56; 165/41, 51
See application file for complete search history.

(56) References Cited

U.S. PATENT DOCUMENTS 4,425,766 A * 1/1984 Claypole ..... 62/133
7,051,786 B2 * 5/2006 Vuk ..... 165/41

FOREIGN PATENT DOCUMENTS

JP 2001-020740 1/2001
JP 2001-020741 1/2001

* cited by examiner

*Primary Examiner*—Stephen K. Cronin
*Assistant Examiner*—Hyder Ali
(74) *Attorney, Agent, or Firm*—Jacobson Holman PLLC

(57) ABSTRACT

It is an object of the invention to provide an engine cooling apparatus that cools an engine according to an operation state of an engine driven work machine. The invention provides an engine cooling apparatus that is adapted to, in an engine drive work machine including an engine and a work machine driven by the engine, cool a radiator of the engine with an electric fan, the engine cooling apparatus including: at least one sensor that senses an operation state of the engine; and a control device that has an inverter, which uses a detection signal of the sensor as an input and the electric fan as a load, and performs operation control for the electric fan according to the operation state of the engine.

3 Claims, 4 Drawing Sheets

ENGINE COOLING APPARATUS

BACKGROUND OF THE INVENTION

1. Field of the Invention

The present invention relates to an engine driven work machine that is driven by an engine to generate an output of a desired form and, more particularly, to an apparatus that appropriately controls cooling of the engine to form a desired output.

2. Related Art

Examples of an engine driven work machine, that is, a work machine using an engine as a drive source include for example a generator, a welding machine, and the like. These are used in urban areas and the like and work day and night, which necessitates provision of anti-noise measures.

There is an engine cooling apparatus in which an engine, a work machine, and other auxiliary machines, and the like are mounted on a common frame and housed in a sound proof case and the engine is cooled by an electric fan provided in the sound proof case (see Japanese Patent Application Laid-Open No. 2001-020740).

There is also an engine cooling apparatus in which, in order to improve engine cooling efficiency, a circuit for generating a voltage signal having frequency-voltage characteristics is incorporated in an automatic voltage regulator to operate an electric fan at the time of rated operation and idling operation (see Japanese Patent Application Laid-Open No. 2001-020741).

Engine cooling apparatuses including electric fans are classified into three types as shown in FIG. 5. There are two types that do not use an inverter (FIGS. 5A and 5B) and one type that uses an inverter (FIG. 5C). In the engine cooling apparatuses that do not use an inverter, an electric fan M is operated at a fixed number of revolutions whether electric power is supplied from a generator G together with an external load L or supplied from a battery B separately from the external load L (FIGS. 5A and 5B). When electric power is supplied from the generator G (FIG. 5A), low-speed operation sufficient for maintaining rotation of the electric fan M is performed at the time of idling of the engine E.

On the other hand, in the engine cooling apparatus that uses an inverter (FIG. 5C), an output of an inverter unit IU can be switched to 50 Hz and 60 Hz such that the engine cooling apparatus can be used throughout Japan. However, since the engine cooling apparatus is designed on the basis of 50 Hz at which an amount of cooling wind is small due to low rotational speed of the electric fan and there is no allowance in continuous operating conditions, it is inevitable that the engine cooling apparatus has allowance when the engine cooling apparatus is used at 60 Hz. The inverter unit IU includes a converter CV, an inverter IV, and a control unit CC.

SUMMARY OF THE INVENTION

The invention has been devised taking into account the above-mentioned points and it is an object of the invention to provide an engine cooling apparatus that cools an engine according to an operation state of an engine driven work machine.

In order to attain the object, the invention provides an engine cooling apparatus that is adapted to, in an engine drive work machine including an engine and a work machine driven by the engine, cool a radiator of the engine with an electric fan, the engine cooling apparatus including: at least one sensor that senses an operation state of the engine; and a control device that has an inverter, which has a detection signal of the sensor as an input and the electric fan as a load, and performs operation control for the electric fan according to the operation state of the engine.

DETAILED DESCRIPTION OF THE INVENTION

Embodiments of the invention will be hereinafter explained with reference to FIGS. 1 to 4.

(First Embodiment)

Figure 1:
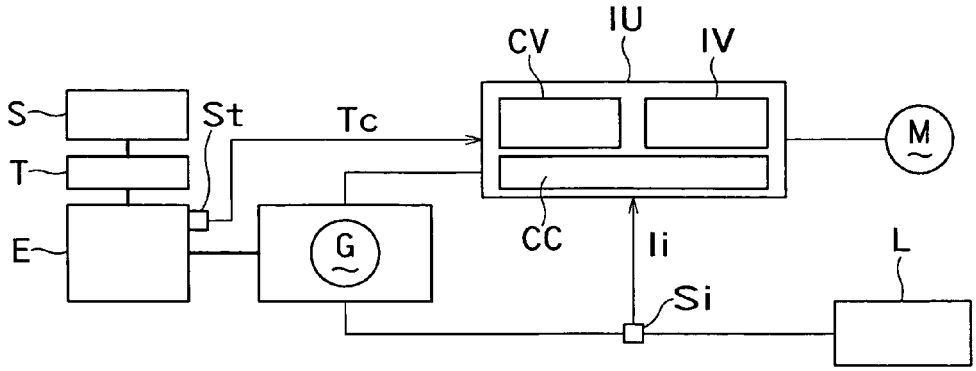
FIG. 1 is a block diagram showing a structure of an engine cooling apparatus in an embodiment of the invention.

FIG. 1 is a block diagram showing an engine cooling apparatus in a first embodiment of the invention. As shown in FIG. 1, an engine E has a throttle T, which is driven by a solenoid S, such that engine speed is increased and reduced. A generator G serving as a work machine driven by the engine E gives an output thereof to an electric fan M via an inverter unit IU on the one hand and supplies electric power to an external load L on the other.

A sensor St obtains a cooling water temperature Tc from the engine E and a sensor Si obtains a load current Ii from the external load L. In order to control the electric fan M, in the inverter unit IU, a control unit CC forms a control signal and gives the control signal to a converter CV and an inverter IV. Consequently, the inverter unit IU gives an appropriate output to the electric fan M.

In the first embodiment, rotational speed of the electric fan M is controlled according to a level of the cooling water temperature Tc of the engine E and a magnitude of the load current Ii.

(Second Embodiment)

Figure 2:
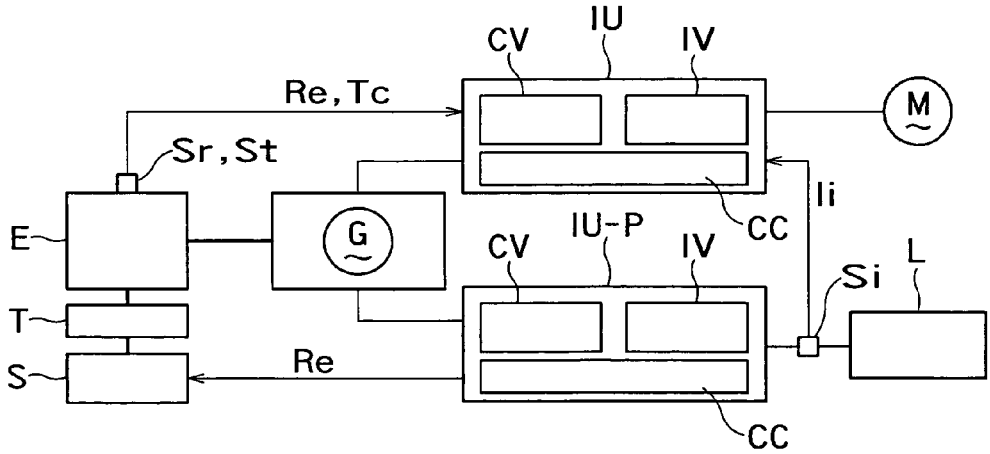
FIG. 2 is a block diagram showing a structure of an engine cooling apparatus in another embodiment of the invention.

FIG. 2 is a block diagram showing a structure of an engine cooling apparatus in a second embodiment of the invention. In the second embodiment, an output circuit structure of the generator G and a control signal of the inverter unit IU are different from those in the first embodiment.

In the first embodiment, an output circuit of the generator G gives an output thereof to the external load L directly. On the other hand, in the second embodiment, an output circuit of the generator G gives an output to the external load L via an inverter unit IU-P for an AC output. As a control signal of the inverter unit IU, whereas the cooling water temperature Tc and the load current Ii are used in the first embodiment, the number of engine revolutions Re is also used in the second embodiment.

Therefore, in the second embodiment, the electric fan M is controlled according to a control signal that is formed on the basis of three elements including the number of engine revolutions Re in addition to the cooling water temperature Tc and the load current Ii.

(Third Embodiment)

Figure 3:
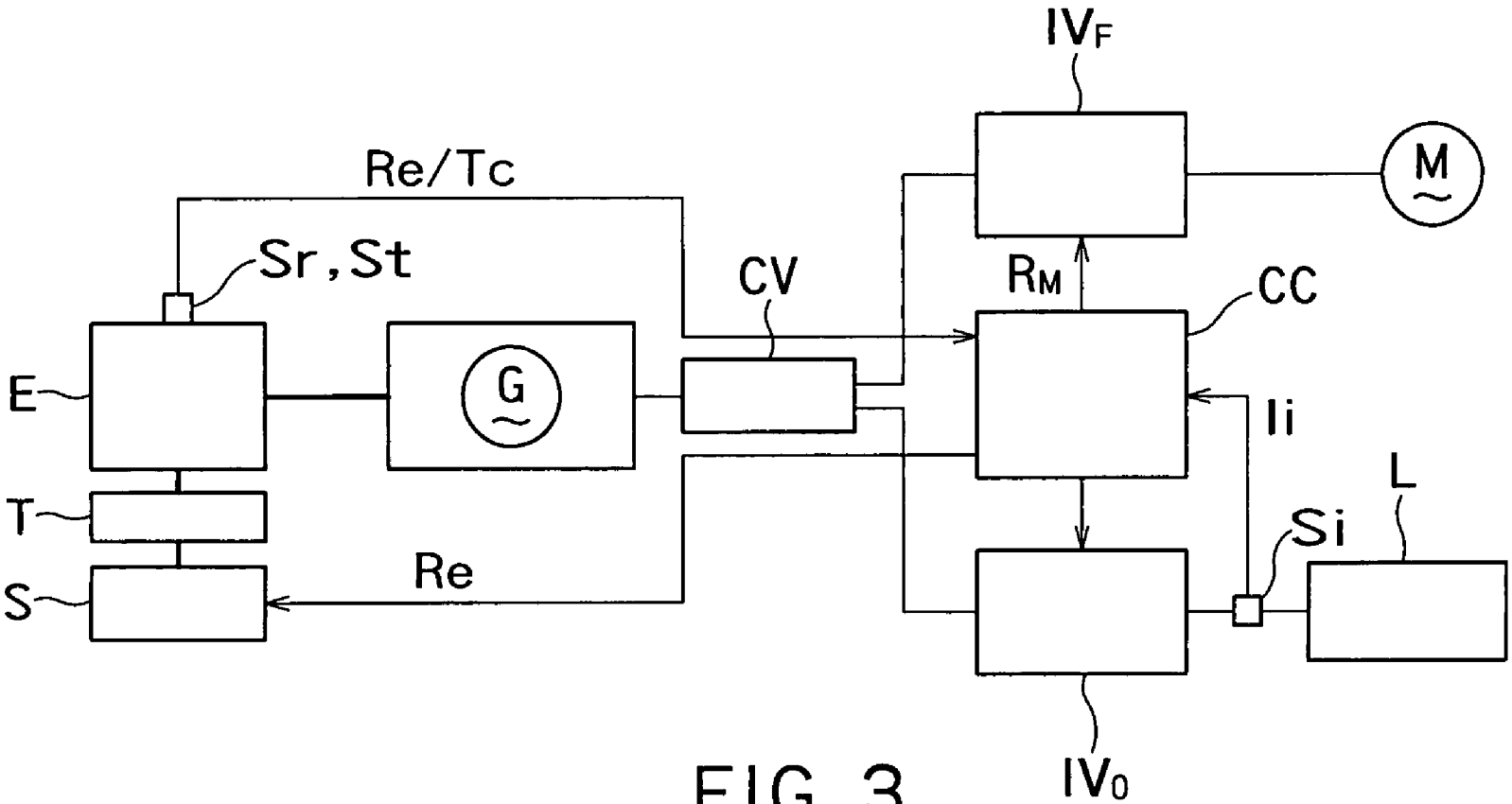
FIG. 3 is a block diagram showing a structure of an engine cooling apparatus in still another embodiment of the invention.

FIG. 3 is a block diagram showing a structure of an engine cooling apparatus in a third embodiment of the invention. The third embodiment is different from the second embodiment in that a converter for an AC output and a converter for an electric fan are integrated into one converter CV and an inverter $IV_O$ for an AC output and an inverter $IV_F$ for an electric fan are driven by the one converter CV.

The control unit CC is the same as that in the second embodiment in that the control unit CC controls the inverter $IV_F$ for an electric fan according to the number of engine revolutions Re, the cooling water temperature Tc, and the load current Ii.

(Operations)

Figure 4:
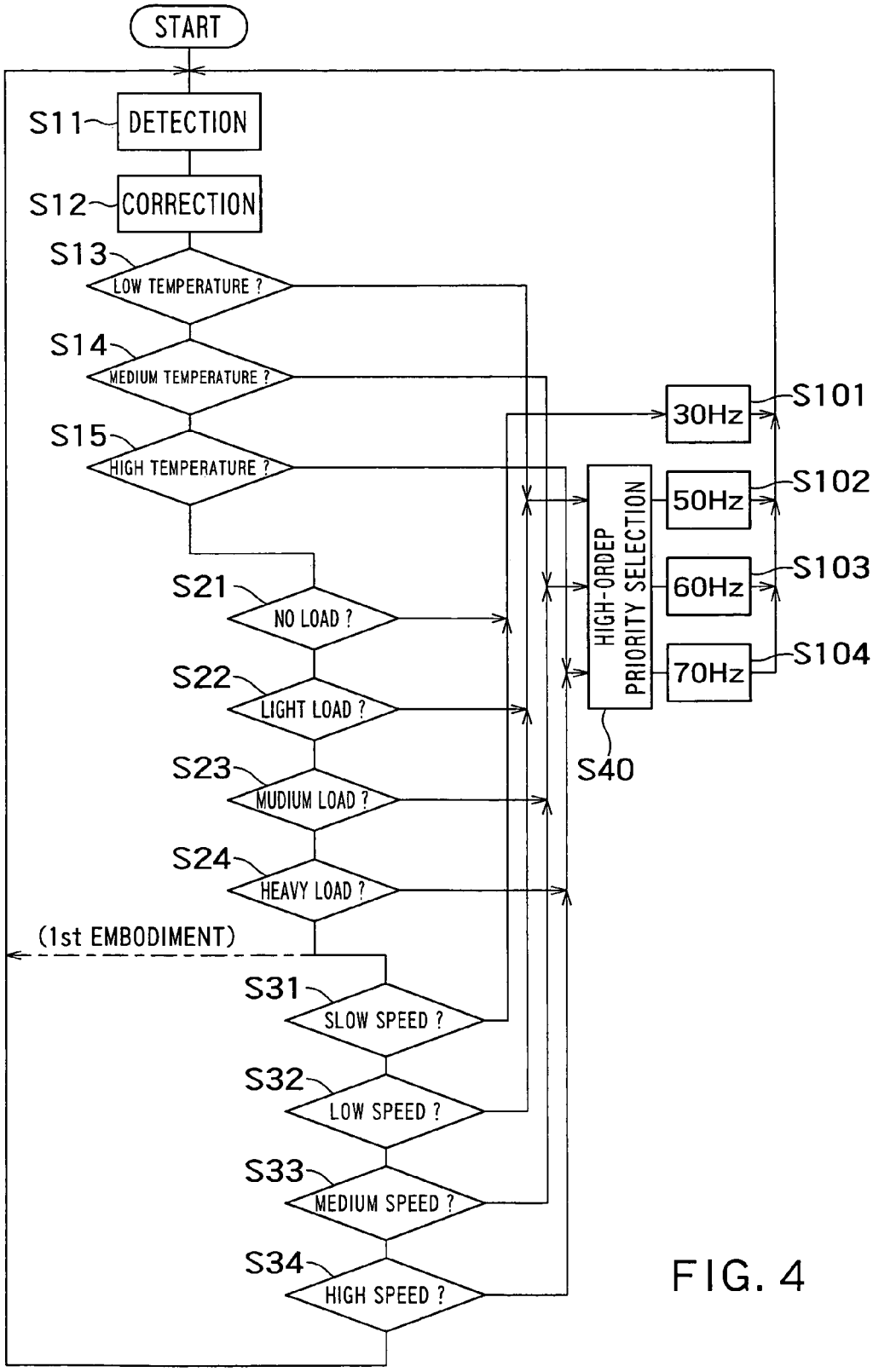
FIG. 4 is a flowchart showing an operation of the engine cooling apparatuses in the embodiments shown in FIGS. 1 to 3.
Figure 5A:
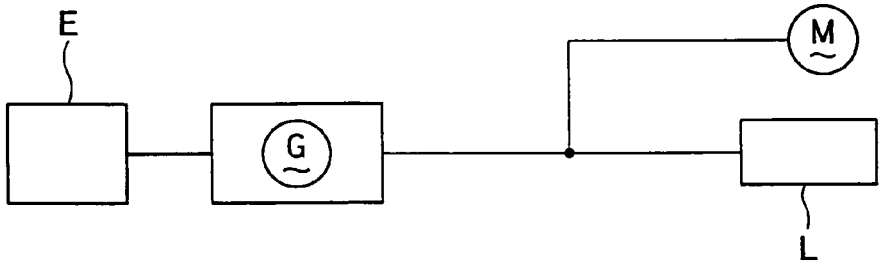
FIG. 5A (PRIOR ART)
FIGS. 5A to 5C are system diagrams showing drive power supplies of conventional electric cooling fans.
Figure 5B:
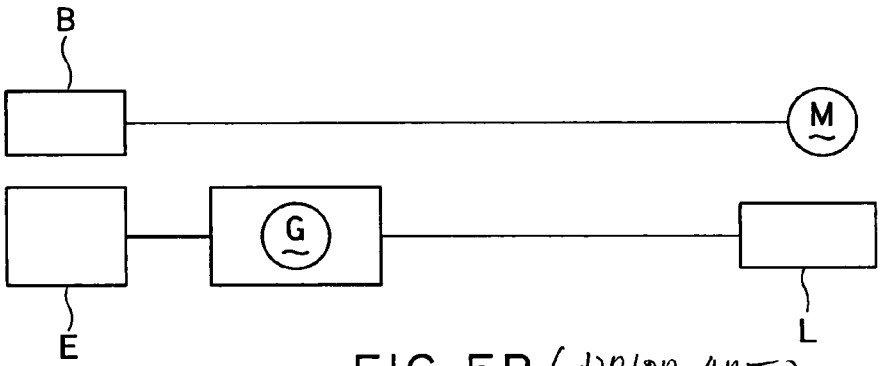
FIG. 5B (PRIOR ART)
Figure 5C:
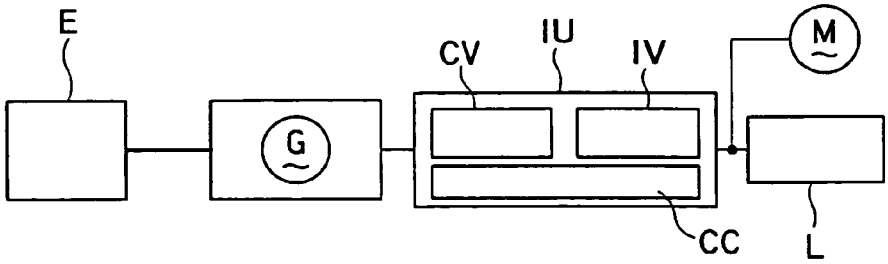
FIG. 5C (PRIOR ART)

FIG. 4 is a flowchart generally showing operations in the first to the third embodiment. In the first embodiment, the control unit CC of the inverter unit IU performs operation control for the converter CV and the Inverter IV on the basis of two detection signals of the engine cooling water temperature Tc and the load current Ii to give an appropriate AC output to the electric fan M. In the second and the third embodiments, the control unit CC of the inverter unit IU performs operation control for the converter CV and the Inverter IV on the basis of three detection signals further including the number of engine revolutions Re to give an appropriate AC output to the electric fan M.

As shown in FIG. 4, in step S11, a started engine cooling apparatus detects signals concerning an engine operation state such as a water temperature, that is, an engine cooling water temperature. In step S12, the engine cooling apparatus performs a necessary correction operation and shifts to control operations in step 513 and subsequent steps.

In step S13, the engine cooling apparatus judges whether the cooling water temperature is in a low temperature range. If the cooling water temperature is in the low temperature range, the engine cooling apparatus operates an electric fan at 50 Hz in step S102 through step S40. When the cooling water temperature is not in the low temperature range, in step S14, the engine cooling apparatus judges whether the cooling water temperature is in a medium temperature range. If the cooling water temperature is in the medium temperature range, the engine cooling apparatus operates the electric fan at 60 Hz in step S103 through step S40. Then, if the cooling water temperature is higher than the medium temperature range, in step S15, the engine cooling apparatus judges whether the cooling water temperature is in a high temperature range. If the cooling water temperature is in the high temperature range, the engine cooling apparatus operates the electric fan at 70 Hz in step S104 through step S40.

In this way, the engine cooling apparatus adjusts operation speed of the electric fan according to whether the engine cooling water temperature is in the low, medium, or high range to operate the electric fan at appropriate speed. After step S15, the engine cooling apparatus proceeds to step S21 (or returns to step S11 as indicated by an imaginary line).

In steps S21 to S24, the engine cooling apparatus performs operation corresponding to a magnitude of the load current Ii. If it is judged in step S21 that no load is applied to the engine, in step S101, the engine cooling apparatus operates the cooling fan at 30 Hz (ultra low speed). On the other hand, when some load is applied to the engine, if it is judged in step S22 that the load is light, in step S102, in principle, the engine cooling apparatus operates the cooling fan at 50 Hz through high-order priority selection in step S40.

Here, a high-order priority selection operation in step S40 will be explained. In the flowchart shown in FIG. 4, one of steps S101 to S104 is selected according to a level or a magnitude of the three elements, namely, cooling water temperature, load, and speed. Since the respective elements are not associated with one another, it is likely that two or more steps among steps S101 to S104 are selected simultaneously. For example, whereas the cooling fan should be operated at 50 Hz because the engine cooling water temperature is in the low temperature range in step S13, the cooling fan is operated as 60 Hz because a medium load is applied to the engine in step S23. In order to set priorities for the elements, the high-order priority selection operation in step S40 is performed.

In step S40 for high-order priority selection, in order to prevent two or more steps among steps S101 to S104 from being selected, a step in which the engine rotates at higher speed among steps S101 to S104 is selected.

Consequently, even if one or more steps of steps S101 to S104 are selected according to steps S13 to S15 for judgment on temperature and steps S21 to S24 for judgment on a load described above and steps S31 to S34 for speed to be described later, the engine cooling apparatus selects one of the steps to operate the electric fan. Here, steps S31 to S34 for judgment on speed are not performed in the first embodiment but are performed in the second and the third embodiment.

Steps S31 to S34 are steps for selecting speed of the electric fan according to an engine speed. As in the case of a cooling water temperature and a magnitude of a load, idling speed (slow speed), low speed, medium speed, and high speed are allocated to steps S31 to S34, respectively.

(Modification)

In the embodiments, the high-order priority selection is performed in order to select one of two or more signals while setting priorities for the signals. However, the high-order priority selection may be replaced with a low-order priority selection by changing a priority standard.

In addition, although an outside air temperature sensor is not used in the embodiments, it is also possible to perform control operation based on the outside air temperature sensor in the same manner as the other sensors.

Moreover, the same advantage is realized when the electric fan and a radiator to be equipped with the engine are replaced with a cooling water circulation pump and a heat recovery heat exchanger, respectively. In other words, a cogeneration system, which controls a pump rotating speed in the same manner as the rotation control for the electric fan to perform heat recovery, may be provided.

As described above, in the invention, since operation control for the electric fan is performed according to the operation state of the engine detected by the sensor, it is possible to always cool the engine properly.

What is claimed is:

1. An engine cooling apparatus in an engine drive work machine including an engine and a work machine driven by the engine, for cooling a radiator of the engine with an electric fan, the engine cooling apparatus comprising:

at least two sensors sensing two or more of a load on the work machine, a number of revolutions of the engine, temperature of cooling water for the engine, and an outside air temperature, and a control device has a function of, when there are two or more contents of control that are obtained on the basis of outputs of the sensors, selecting one of the contents of control in a high-order priority selection operation.

2. The engine cooling apparatus of claim 1, wherein the sensors output at least three stages of outputs, including low, medium and high outputs, respectively.

3. The engine cooling apparatus of claim 1, wherein the electric fan is controlled at at least three stages including ultra low speed, light load stage and heavy load stage according to the high-order priority selection operation.

* * * * *